US006403906B1

(12) United States Patent
De Leo et al.

(10) Patent No.: US 6,403,906 B1
(45) Date of Patent: Jun. 11, 2002

(54) METHOD FOR CONTROLLING AN ACCUMULATING DEVICE

(75) Inventors: Guido De Leo; Francesco Stomeo, both of Genoa (IT)

(73) Assignee: Elsag SPA, Genoa (IT)

( * ) Notice: Subject to any disclaimer, the term of this patent is extended or adjusted under 35 U.S.C. 154(b) by 0 days.

(21) Appl. No.: 09/437,631

(22) Filed: Nov. 10, 1999

(30) Foreign Application Priority Data

Nov. 10, 1998 (IT) ..... TO98A0948

(51) Int. Cl.[7] ..... B07C 5/00

(52) U.S. Cl. ..... 209/584; 209/900; 209/933; 271/4.01

(58) Field of Search ..... 209/552, 559, 209/584, 656, 900, 933; 271/3.14, 4.01, 4.02

(56) References Cited

U.S. PATENT DOCUMENTS 5,667,078 A * 9/1997 Walach ..... 209/584
5,810,174 A * 9/1998 Hamada et al. ..... 209/584
5,924,576 A * 7/1999 Steenge ..... 209/900

FOREIGN PATENT DOCUMENTS

EP 566456 * 10/1993 ..... 209/584

* cited by examiner

*Primary Examiner*—Tuan N. Nguyen
(74) *Attorney, Agent, or Firm*—Darby & Darby

(57) ABSTRACT

Method for controlling an accumulating device (buffer) having a number of tracks each of which defines at least one accumulation segment along which may be arranged sets of postal items partially overlying each other (shingled). One first section and one second section are defined as including, respectively, one first and one second sub-set of tracks designed to communicate at output, through singling devices, with sorting devices. For each section, successive phases of accumulation and unloading are carried out, thus achieving with great efficiency the unloading of postal items towards sorting devices, and thus enabling the handling of a large number of postal items towards the highest possible number of destinations.

31 Claims, 7 Drawing Sheets

METHOD FOR CONTROLLING AN ACCUMULATING DEVICE

BACKGROUND OF THE INVENTION

Accumulating devices (buffers) are known that are designed to receive as input flows of plane, generally rectangular, postal items (letters, postcards, documents enclosed in envelopes, etc.), which are stored inside the accumulating device, thus forming sets of postal items. In particular, it is known that postal items may be stored partially overlying one another (shingled), aligned along a basically rectilinear direction, with their front edges spaced by a controlled pitch. The sets of postal items are generally arranged along tracks of the accumulating device and may be transported towards outputs of the accumulating device, at which outputs the sets of postal items are subjected to singling to yield the single postal items to subsequent post-office machines.

In particular, it is known that accumulating devices can be used in combination with mail-sorting devices. According to this application, the mail-sorting devices receive as input single postal items coming from the accumulating device and are designed to feed each individual item towards a corresponding output of the mail-sorting device according to a code associated to the postal item (e.g., a bar code stamped on it) that identifies the postal destination of the item itself.

Conveniently, mail-sorting devices are provided with reading programmes which are able to recognize the code associated to the postal item so as to select a specific output towards which the postal item is to be sent.

SUMMARY OF THE INVENTION

A purpose of the present invention is to create a method for controlling an accumulating device which ma y achieve unloading of postal items towards the mail-sorting device with great efficiency.

A further purpose of the present invention is to create an accumulating device which enables the handling of a large number of postal items towards the highest possible number of destinations.

The former purpose is achieved by the present invention in that it regards a method for controlling an accumulating device of the type described in claim 1.

BRIEF DESCRIPTION OF THE DRAWINGS

The invention will now be illustrated with particular reference to the attached drawings which show a preferred, albeit non-limiting, embodiment of the invention, where.

DETAILED DESCRIPTION OF THE INVENTION

Figure 1:
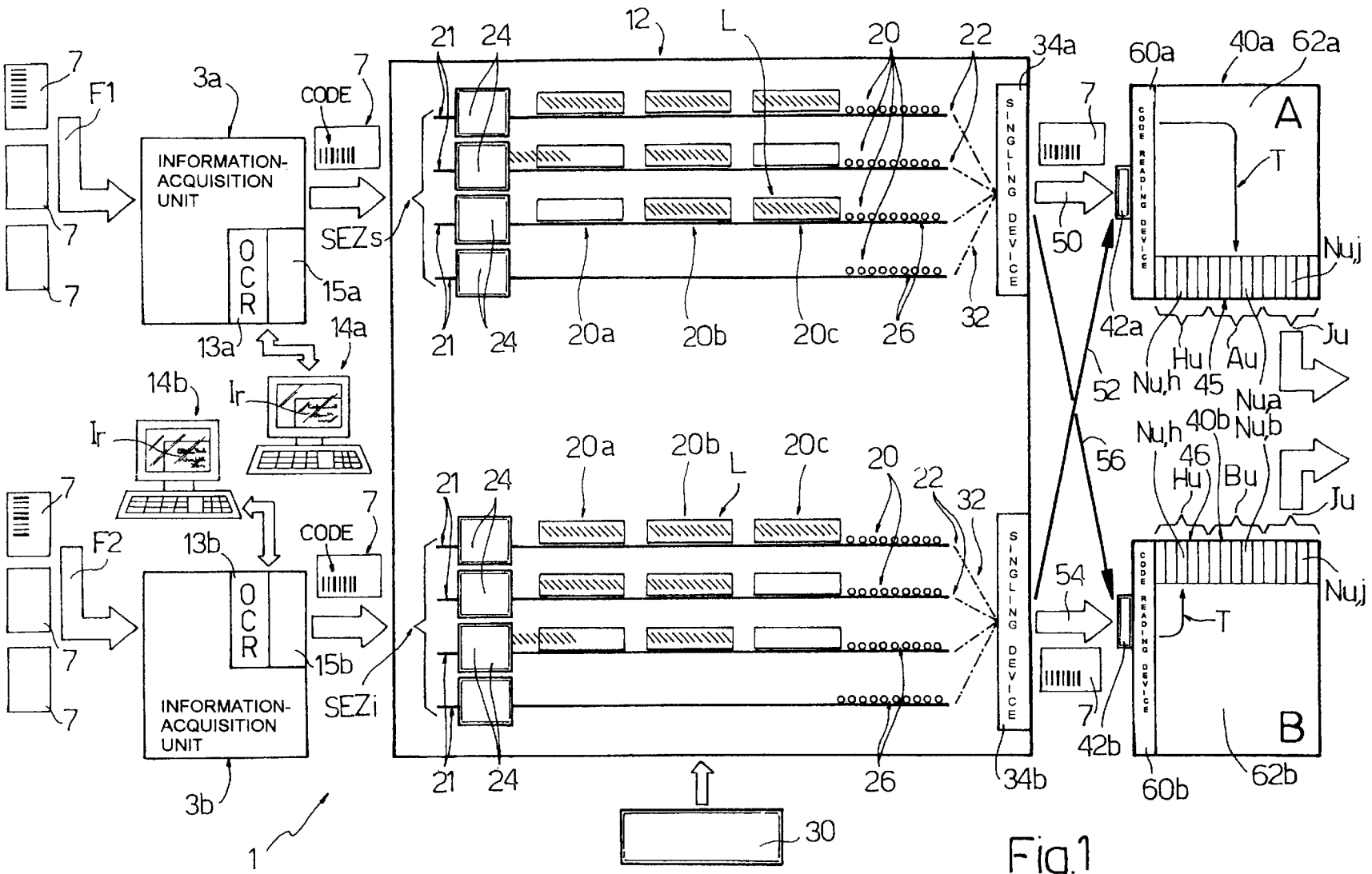
FIG. 1 is a schematic representation of an accumulating device operating according to the method of the present invention.

With particular reference to FIG. 1, a post-office machine operating according to the dictates of the present invention is, as a whole, indicated by 1.

The machine 1 comprises one first information-acquisition unit, 3*a*, which is designed to receive as input a flow F1 of plane, rectangular postal items 7 (letters, postcards, documents enclosed in envelopes, etc.) and is designed to feed, as output, postal items to an accumulating device 12 (buffer) operating according to the method of the present invention.

In particular, the information-acquisition unit 3*a* receives as input a number of postal items 7, each of which is associated to a piece of information that identifies its destination (country, town, postcode, street, number, etc.). This information may be presented, in different types of mail, in the following forms:

- as a bar code stamped on the postal item itself;
- as machine-written information (typewritten or printed); and
- as hand-written information, in particular as cursive handwriting.

The information-acquisition unit 3*a* is designed to detect an image of the postal item in which the information is visible and is designed to process this image so as to draw the information itself from it.

Preferably, but not exclusively, the information-acquisition unit 3*a* may perform the following automatic processes:

- attempt to read the bar code (this phase is carried out by means of a BCR—i.e., bar code reader, not illustrated herein—or by means of a known algorithm for reading the bar code on an image of the item that has been detected);
- attempt to read the typewritten text (this phase is normally carried out by means of an OCR device 13*a*); and
- attempt to read the handwriting (this phase is normally carried out by means of an RCR device).

A recognition attempt may moreover be carried out via videocoding through which an IR image of the postal item is presented to an operator (not illustrated). The operator enters manually, i.e., via keyboard, the destination data that characterize the postal item represented in the IR image.

Preferably, the IR-detected image may be represented on a video terminal 14*a*, connected, via a data line, with the information-acquisition unit 3*a* and set in a remote position (for example, located in a town distant from the town in which the machine 1 is located).

Following on the operations of the information-acquisition unit 3*a*, each item is normally identified (i.e., the data regarding its destination are fully detected—RESOLVED postal item) and associated to a destination; the postal items identified (RESOLVED) are moreover fed to the accumulating device 12.

A number of postal items, however, are not identified through the automatic processes (i.e., the data regarding the destination of the item are not detected—UNRESOLVED postal item), and must undergo a videocoding process; the postal items that have not been identified (UNRESOLVED) are even so fed to the accumulating device 12, inside which they are arranged awaiting the completion of the videocoding process.

In particular, in the case where the destination associated to the postal item is detected completely, a first type of bar code or destination code (CODE1) which identifies uniquely the destination of the postal item is stamped on it. If, instead, the physical destination associated to the postal item is not detected automatically, a second type of bar code or ID-TAG (CODE2), which merely identifies the IR-detected image of the item, is stamped on the latter.

These codes may be stamped by a coded writing unit 15*a*.

The machine 1 may further comprise a second information-acquisition unit 3*b* which receives as input a flow F2 of postal items and has a structure and functions exactly the same as those of the unit 3*a*, and consequently is not described in detail herein.

Corresponding elements and parts are indicated by the same numbers accompanied by the subscript b.

The mail flows F1 and F2 comprise postal items set mixed, i.e., comprising different destinations and different types of mail; for example, flows F1 and F2 comprise postal items directly taken from post-boxes.

The accumulating device 12 receives as input the postal items fed as output from the information-acquisition units 3*a* and 3*b* and comprises a number of tracks 20, each of which extends between an input 21, designed to receive the postal items coming from the information-acquisition units 3*a* and 3*b*, and an output 22.

At the beginning of each track 20, there is moreover set a flow-forming device 24 (of a known type), which receives the postal items coming from the units 3*a* and 3*b* and feeds as output partially overlying (shingled) postal items, i.e., postal items set aligned along a rectilinear track with the corresponding front edges spaced apart by a controlled pitch.

In the example of embodiment illustrated, at least six tracks 20 are present.

The shingled postal items are fed to adjacent consecutive accumulation segments 20*a*, 20*b*, 20*c* of each track 20. In particular, each segment 20*a*, 20*b*, 20*c* is designed to house the shingled postal items, thus forming a corresponding batch L of shingled postal items.

In other words, the shingled postal items are accumulated on each segment 20*a*, 20*b*, 20*c*, thus forming a batch (batch being formed), which increases in length with the arrival of further postal items. When the maximum number of shingled postal items set on the segment is reached, the batch L is considered complete (closed batch).

In the example of embodiment represented, each track 20 comprises three segments and is therefore able to receive three batches L set in series. Different batches are moreover physically separated from each other. It is obviously also possible to envisage, for each track 20, a single segment 20*a*; in this case, the postal items would be accumulated on the track according to a single batch L.

The last segment 20*c* of the track 20 moreover communicates with a conveying device 26 which extends between the segment 20*c* itself and the output 22 of the track 20. The conveying device 26 is designed to move in a rigid way each batch L, i.e., is designed to convey the shingled postal items towards the output 22, maintaining the relative positions between the various postal items that form part of the batch.

The formation of the batches and their conveyance by means of the conveying device 26 are controlled, through algorithms of a known type, by a control unit 30 co-operating with the accumulating device 12.

Each output 22 of a track 20 may moreover communicate, by means of a corresponding confluence device 32 (represented schematically), with one first singling device 34*a* or one second singling device 34*b*, each of which is designed to receive as input the batches of shingled postal items to feed, as output, singled items, i.e., ones physically spaced apart.

The post-office machine 1 further comprises one first mail-sorting device 40*a* presenting an input 42*a* and a number of outputs 45, and one second mail-sorting device 40*b* presenting an input 42*b* and a number of outputs 46.

In particular, the first input 42*a* can receive the postal items coming as output from the first singling device 34*a* and travelling along a top direct track 50, or else can receive the postal items coming from the second singling device 34*b* and coming from one first crosswise track 52, whilst the second input 42*b* can receive postal items coming as output from the second singling device 34*b* and travelling along a bottom direct track 54, or else can receive the postal items coming from the first singling device 34*a* and coming from one second crosswise track 56.

The input 42*a* is associated to a code reader device 60*a*, designed to read the code CODE1 or CODE2 associated to the postal item 7, so as to control, according to the code read, a routing device 62*a* of the mail-sorting device 40*a* which presents a track T from the input 42*a* to one of the outputs 45, thus addressing the postal items towards a given output 45.

The input 42*b* is associated to a code reader device 60*b*, designed to read the code CODE1 or CODE2 associated to the postal item 7, so as to control, according to the code read, a routing device 62*b* of the mail-sorting device 40*b* which presents a track T from the input 42*b* to one of the outputs 46, thus addressing the postal items towards a given output 46.

The first sorting device 40*a* performs a first sorting programme, referred to as programme A (PROG-A), according to which the code previously read and associated to the postal item is converted (for instance, by means of a table) into an output number, and in particular:

- the code previously read is converted into a first output number Nu,h sending the postal item to a physical output 45 belonging to one first subset Hu of outputs 45 (comprising, for example, one hundred outputs);
- the code previously read is converted into an output number Nu,a sending the postal item to a physical output belonging to one second subset Au of outputs (comprising, for example, one hundred outputs); and
- the code previously read is converted into an output number Nu,j sending the postal item to a physical output belonging to one third subset Ju of outputs 45 (comprising, for example, four outputs).

The second sorting device 40*b* performs a second sorting programme, referred to as programme B (PROG-B), different from the sorting programme A. According to the sorting programme B, the code previously read and associated to the postal item is converted (by means of a table) into an output number, and in particular:

- the code previously read is converted into an output number Nu,h sending the postal item to a physical output belonging to one first subset Hu of outputs 46 (comprising, for example, one hundred outputs);
- the code previously read is converted into an output number Nu,b sending the postal item to a physical output belonging to one second subset Bu of outputs 46 (comprising, for example, one hundred outputs); and
- the code previously read is converted into an output number Nu,j sending the postal item to a physical output belonging to one third subset Ju of outputs 46 (comprising, for example, four outputs).

The postal items arranged in the outputs Hu, Au, Bu selected by the sorting programme A or B do not have to undergo subsequent cycles of mail handling; in particular, each output Au, Bu, Hu selected by a corresponding sorting programme A or B, referred to above, contains postal items comprising a given postal destination to which they can be forwarded directly, whilst each output Ju selected by a corresponding sorting programme A or B contains a number of postal items that belong to different destinations and are designed to undergo at least one subsequent mail-handling programme.

The programmes A and B are different from each other in order to be able to manage a higher number of outputs; in the example of embodiment illustrated, the number of outputs Np housing items ready to be forwarded to a given postal destination are:

Np=number of outputs Nu,a+number of outputs Nu,b+number of outputs Nu,h (the outputs Nu,h of the sorting devices 40*a* and 40*b* in fact correspond).

In this way, the handling of a large number of postal items towards a large number of possible destinations is enabled.

The number of outputs Nnp housing items that are to undergo further mail handling are:

Nnp=number of outputs Nu,j (the outputs Nu,j of the mail-sorting devices 40*a* and 40*b* in fact correspond).

The total number Nt of outputs managed is therefore $$Nt=Np+Nnp$$

In the ensuing description, reference will be made to:

postal items A (or mail A), this term meaning the postal items that can be usefully sorted (i.e., that do not have to undergo further cycles of mail handling) by the programme A alone; to this set of mail A belong the postal items that are addressed by the sorting programme A towards the outputs Nu,a;

postal items B (or mail B), this term meaning the postal items that can be usefully sorted (i.e., that do not have to undergo further cycles of mail handling) by the programme B alone; to this set of mail B belong the postal items that are addressed by the sorting programme B towards the outputs Nu,b;

postal items R (R, or UNRESOLVED, mail), this term meaning the postal items introduced into the accumulating device 12 still without the information on their destination (i.e., characterized by a CODE2 that identifies only the image of the item itself but does not furnish any data on the destination of the item);

postal items H (or mail H), i.e., residual mail that can be usefully sorted by both the programmes A and B; to this set of mail H belong the postal items that are addressed by the sorting programme A or B towards the outputs Nu,h and Nu,j.

The above definitions are to be understood as regarding postal items as these are referred to upon introduction inside the accumulating device 12.

In the ensuing description, by the term "section" is meant a sub-set of tracks 20 of the buffer 12 having respective outputs 22 connected and/or communicating with a corresponding singling device 34*a* or 34*b*. According to the example of embodiment of the present inventions, two sections are created (a top section, SEZs, and a bottom section SEZi), each of which can communicate with the singling device 34*a* or with the singling device 34*b*.

In the example of embodiment illustrated, each section comprises at least three tracks 20.

In particular, according to the present invention, each section of the accumulating device 12 can operate according to one of the following phases of ordinary operation:

Phase A: during this phase, the section of the buffer 12 is connected and/or is designed to communicate (via the singling device 34*a*) with the sorting device 40*a* which carries out the sorting programme A;

Phase B: during this phase, the section of the buffer 12 is connected and/or is designed to communicate (via the singling device 34*b*) with the sorting device 40*b* which carries out the sorting programme B;

Each section of the buffer 12 may moreover carry out transition phases; namely:

Phase A→B (A towards B): during this phase, the section of the buffer 12 that is currently still connected and/or communicating with the sorting device 40*a* according to the sorting programme A previously activated is managed so as to optimize a subsequent transition designed to enable feeding of a different sorting device (40*b*) carrying out the sorting programme B;

Phase B→A (B towards A): during this phase, the section of the buffer 12 that is currently still connected and/or communicating with the sorting device 40*b* according to the sorting programme B previously activated is managed so as to optimize a subsequent transition designed to enable feeding of a different sorting device (40*a*) carrying out the sorting programme A.

In phase A, moreover, on each track 20 belonging to the section that is in phase A, the following may be accumulated:

batches of postal items comprising mail A and mail H;

batches of postal items comprising mail R; and batches of postal items comprising mail B.

In particular, each batch of postal items comprising mail B can be formed until it reaches the maximum accumulation capacity so as to form closed batches of mail B.

During phase A, finally, by means of the conveying device 26 and the singling device 34*a*, the singling device 34*a* is fed with the batches of postal items comprising mail A and mail H and the batches of postal items comprising mail Rp which is ready, i.e., mail R for which the information on destination has arrived by means of the videocoding process activated during the stay of the mail R inside the accumulating device 12. The batches of postal items comprising mail B are not conveyed towards the output of the accumulating device 12, and are withheld inside the accumulating device 12.

In this way, the section set in the ordinary phase A accumulates, and unloads towards the sorting device, the mail A that constitutes a type of mail typical for the sorting programme, which receives it, in that this programme recognizes it and handles it, whereas the mail B constitutes an atypical type of mail, in that it would not be recognized and sorted usefully by the sorting device operating with programme A.

In phase B, on each track 20 belonging to the section that is in phase B, the following may be accumulated:

batches of postal items comprising mail B and mail H;

batches of postal items comprising mail R; and batches of postal items comprising mail A.

In particular, each batch of postal items comprising mail A can be formed until it reaches the maximum accumulation capacity envisaged for that phase so as to form closed batches of mail A.

During phase B, finally, by means of the conveying device 26 and the singling device 34*b*, the singling device 34*b* is fed with the batches of postal items comprising mail B and mail H and the batches of postal items comprising mail Rp which is ready, i.e., mail R for which the information on destination has arrived by means of the videocoding process activated during the stay of the mail R inside the accumulating device 12. The batches of postal items comprising mail A are not conveyed towards the output of the accumulating device 12, and are withheld inside the accumulating device 12.

In this way, the section set in the ordinary phase B accumulates, and unloads towards the sorting device, the mail B that constitutes a type of mail typical for the sorting programme, which receives it, in that this programme recognizes it and handles it, whereas the mail A constitutes a type of atypical mail, in that it would not be recognized and sorted usefully by the sorting device operating with programme B.

In the phase A→B (A towards B), the batches of mail A are fed with maximum priority to the singling device 34*a* in order to unload all the closed batches of mail A from the section in the shortest time possible. Only possible batches of mail A being formed are not unloaded.

In particular, each set of postal items included in one section is characterized by a RANK index indicating the degree of priority at output from the section. The set of postal items having a RANK index higher than the indices of the other sets is the first to be forwarded towards the singling device and to be expelled from the section. In this way, in the phase A→B, the RANK index of the batches of mail A is increased, thus enabling preferential output of the batches of mail A with respect to other sets of postal items.

During the phase A→B, the mail H is preferably kept separate from the mail A and accumulated on dedicated tracks 20.

During the phase A→B, the batches of mail B are withheld inside the accumulating device 12.

In the phase B→A (B towards A ), the batches of mail B are fed with maximum priority to the singling device 34*b* in order to unload all the closed batches of mail B from the section in the shortest time possible. Only possible batches of mail B being formed are not unloaded.

During the phase B→A, the mail H is preferably kept separate from the mail B and accumulated on dedicated tracks 20.

During the phase B→A, the batches of mail A are withheld inside the accumulating device 12.

Figure 2:
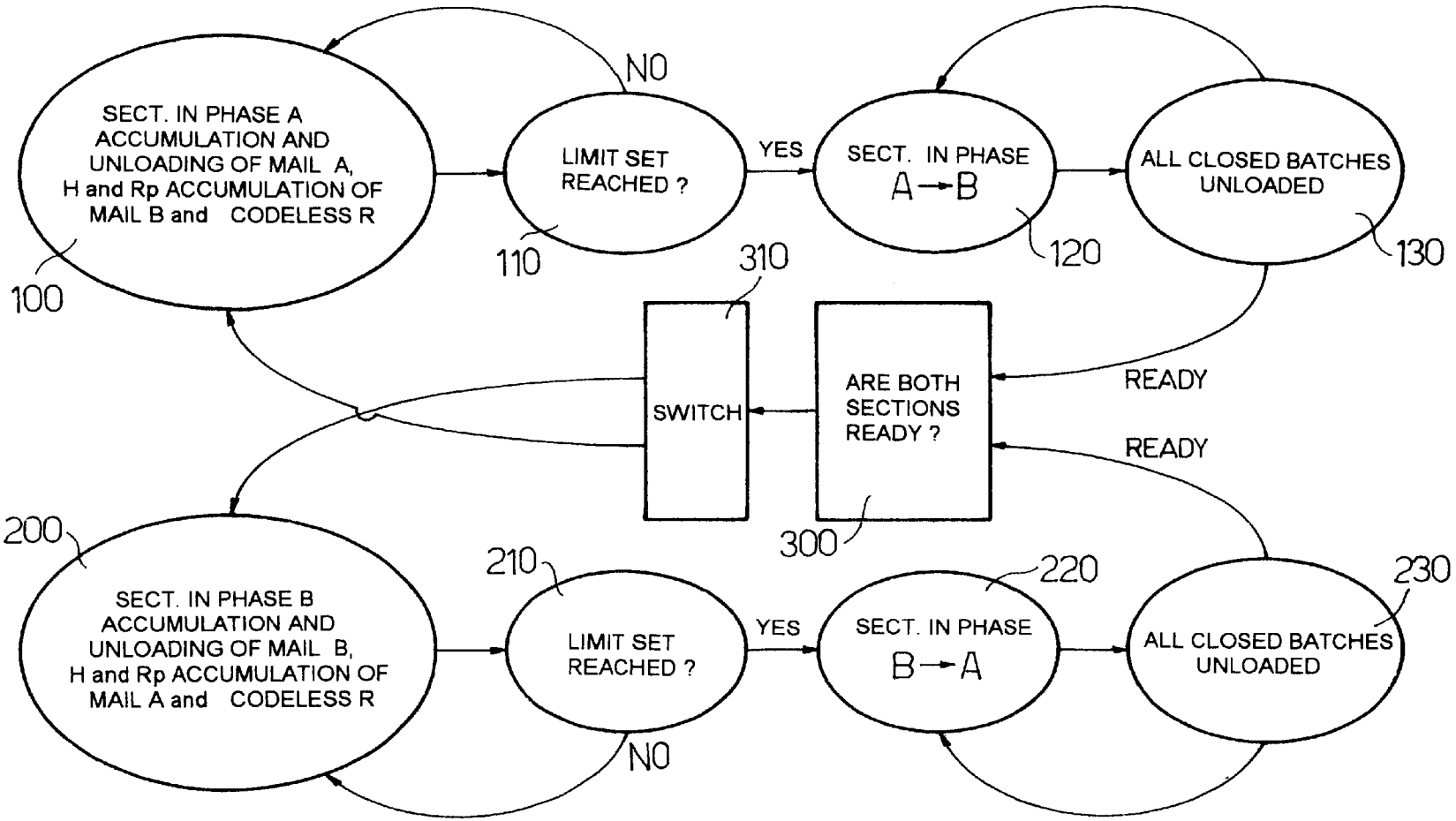
FIG. 2 presents a block diagram for phases of the method of the present invention.

The transitions between the various phases referred to above will be illustrated with the aid of the block diagram of FIG. 2, which illustrates a preferred form of operation of the buffer 12 according to the present invention.

Figure 3A:
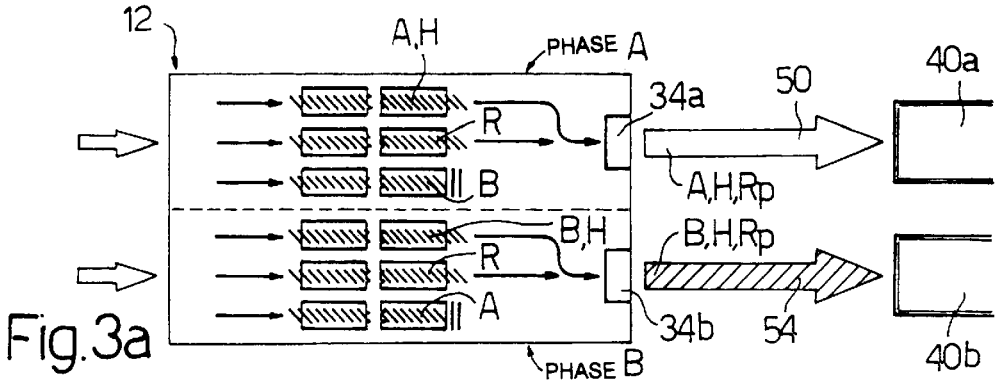
FIGS. 3*a*–3*d* present diagrams of phases of the method of the present invention.

The block 100 represents a state in which a first section of the buffer 12 (for example, the top one) is in phase A FIG. 3*a*). During the operations of the block 100 (phase A), the first section is designed to communicate (for example, via the track 50) with the first sorting device 40*a*. Furthermore, singled mail A, H and Rp (ready) is unloaded, whereas the mail B is accumulated. The mail R, i.e., the mail that is not ready, is withheld inside the accumulating device 12 awaiting coding on destination.

At the same time as the block 100 (block 200) operation, a second section (for example, the bottom section of the machine) of the buffer 12 is in phase B (FIG. 3*a*). During the operations of the block 200 (phase B), the second section is designed to communicate (for example, via the track 54) with the second sorting device 40*b*. Furthermore, singled mail B, H and Rp (ready) is unloaded, whereas the mail A is accumulated. The mail R, i.e., the mail that is not ready, is withheld inside the accumulating device 12 awaiting coding on destination.

The first section of the buffer can remain in phase A (block 100) until the accumulation limit set for mail B is reached; when this accumulation limit is reached, a block 120 is arrived at which issues a command for activation of phase A→B (A towards B).

The second section of the buffer can remain in phase B (block 210) until the accumulation limit set for mail A is reached; when this accumulation limit is reached, a block 220 is arrived at which issues a command for activation of phase B→A (B towards A).

The transition from block 110 to block 120 moreover issues a command for transition from block 210 to block 220, and the transition from block 210 to block 220 moreover issues a command for transition from block 110 to block 120. In this way, when one section of the buffer 12 is in phase A, the other section is necessarily in phase B (and vice versa).

Consequently, when one section is in phase A→B (A towards B), the other section is phase B→A (B towards A).

Figure 3B:
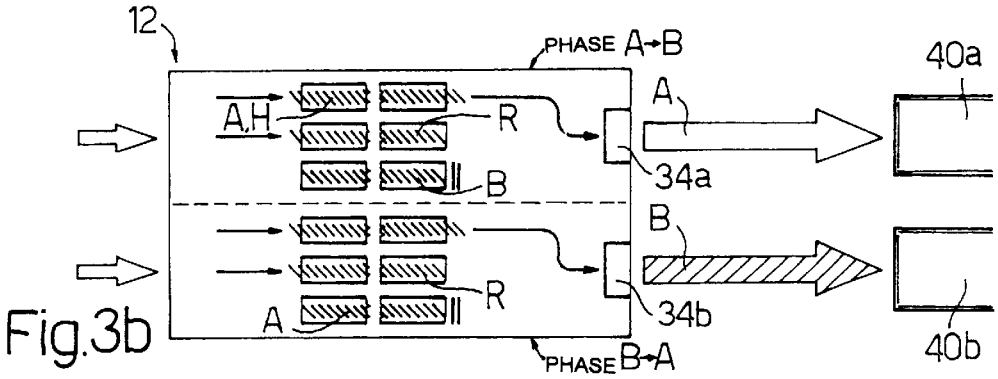

The block 120 represents the phase A→B (A towards B) in which the mail A is unloaded with maximum priority (FIG. 3*b*).

The operations of unloading of all the closed batches of mail A are monitored by a block 130. When all the closed batches of mail A have been unloaded, the section continues to remain in phase A→B; the section is moreover declared ready (READY) to terminate the current phase, even though it is still kept in phase A→B.

The block 220 represents the phase B→A (B towards A) in which the mail B is unloaded with maximum priority (FIG. 3*b*).

The operations of unloading of all the closed batches of mail B are monitored by a block 230. When all the closed batches of mail B have been unloaded, the section continues to remain in phase B→A; the section is moreover declared ready (READY) to terminate the current phase, even though it is still kept in phase B→A.

A block 300 is reached when both sections have declared that they are ready (READY).

Figure 3C:
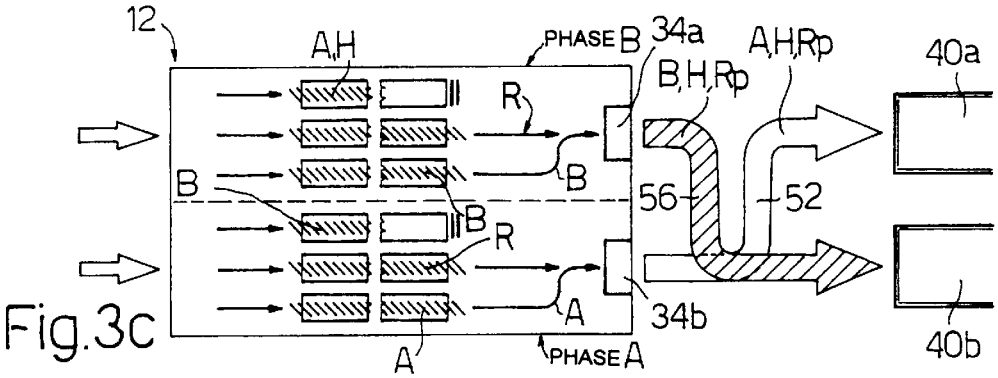

The block 300 is followed by a block 310 which switches the connections (FIG. 3*c*) between the first section of the buffer 12 and the first sorting device 40*a*, and the second section of the buffer 12 and the second sorting device 40*b*.

The first section of the buffer 12 is thus connected with the second sorting device 40*b* (for example, via the track 56), and the second section of the buffer 12 is connected with the first sorting device 40*a* (for example, via the track 52).

The first section of the buffer contains a large amount of mail B (on account of the accumulation operations of the block 100) and a modest quantity of mail A (thanks to the unloading operations of the block 120); this section is now directly connected with the second sorting device 40*b*, which is provided with the sorting programme B. In this way, for the first section of the buffer 12, a phase B is started up which guarantees prolonged handling of the mail B, thus enabling a large number of postal items B to be unloaded from the buffer 12 together with the postal items H and Rp (ready).

At the same time, the second section of the buffer contains a large amount of mail A (on account of the accumulation operations of the block 200) and a low quantity of mail B (thanks to the unloading operations of the block 220); this section is now directly connected with the first sorting device 40*a*, which is provided with the sorting programme A. In this way, for the second section, a phase A is started up which guarantees prolonged handling of the mail A, thus enabling a large number of postal items A to be unloaded from the buffer 12 together with the postal items H and Rp (ready).

The first section of the buffer (in the example illustrated, the top one) is then set in phase B (block 200), and the second section of the buffer (in the example illustrated, the bottom one) performs phase A (block 100).

Figure 3D:
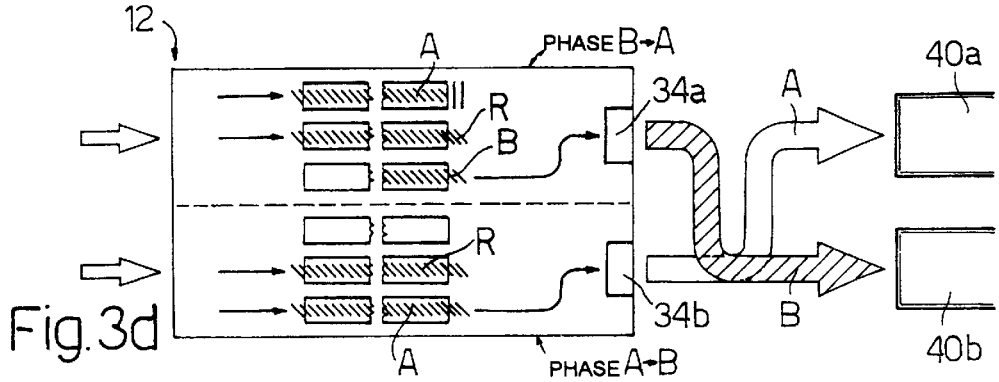

When one of the two blocks 110 or 210 is reached, the first section of the buffer (in the example illustrated, the top one)

is now set in phase B→A (block 220), and the second section of the buffer (in the example illustrated, the bottom one) performs phase A→B (block 100, FIG. 3*d*). When the block 300 and the subsequent block 310 are reached, the first section is again connected to the first sorting device via track 50, whilst the second section is connected to the first sorting device via track 54 (FIG. 3*a*). The first section is now in phase A again, and the second section in phase B, and the operations previously described repeat in a cyclic fashion.

From what has been said above, the advantages of the present invention emerge clearly, in that greater efficiency is achieved since the "productive" phases (phases A and B and blocks 100 and 200), during which postal items previously accumulated are unloaded, are prolonged as much as possible, and the number of switches (block 310) and preparatory phases for these switches (phases A→B and B→A, blocks 120 and 220) are reduced to the minimum.

The example of embodiment illustrated regards a case in which two sorting devices are present that are physically distinct from one another and operate according to sorting programmes (programmes A and B) which are different from one another. According to this example of embodiment, it is necessary to perform a physical switch (i.e., to use tracks 50, 54 or 56, 52) in order to feed each sorting device with the mail previously accumulated in batches (for example, batches of mail B and batches of mail A) and corresponding to the specific sorting programme fed by the particular sorting device. In this connection, it may be noted how the batches of mail B accumulated in phase A are fed, following upon switching of the block 310, to the sorting device 40*b* which is specifically designed to handle mail B (typical mail), and the batches of mail A accumulated in phase B are fed, following upon switching of the block 310, to the sorting device 40*a*, which is specifically designed to handle mail A (typical mail).

In addition to the operating phases described above, the method for controlling the accumulating device 12 could comprise a further phase S which is activated in critical conditions of operation of any one of the two sections.

According to said phase S, one of the two sections of the buffer 12 that is in critical conditions sets itself in a state of reduced operation or degraded operation, whilst the other section is kept in a phase of ordinary operation, and can therefore perform phase A, phase B, phase A towards B, and phase B towards A.

In order to establish start-up of said phase S, in both sections SEZi and SEZs the quantity of mail R that is not yet ready, i.e., still without the data characterizing its postal destination, is constantly monitored, and when the quantity of non-ready mail exceeds a pre-set reference limit in one section, a command is issued for start of phase S for that section.

The mail R (not ready) is, in fact, always kept separated from mail A, B or H, and must be accumulated along tracks 20 dedicated exclusively to mail R. The increase in the number of tracks occupied by mail R obviously results in a decrease in the number of tracks available for accumulation of mail A, B or H. For this reason, following on the exceeding of a certain quantity of mail R accumulated in one section, i.e., following on occupation of a certain number of tracks occupied by said mail R, the number of tracks available for the other types of mail proves insufficient, and the phases of normal operation can no longer be continued for that section. In these conditions (few tracks available and a large amount of mail to be handled), for the above-mentioned section the degraded operation mode S is activated.

It is moreover possible to arrive at phase S by means of a previous supervision command issued by the control unit 30.

According to the degraded operating mode S, the mail A is accumulated together with the mail B (and the mail H), whilst the mail R is kept separate from the other types of mail. In addition mail A, B, H and Rp (ready) is unloaded.

In addition, the synchronisms between the two sections are eliminated, in that the operations of the section that performs phase S are independent of the phases carried out in the other section, which performs the ordinary phases A, B, A towards B, and B towards A.

In particular, in the case where the section performing the ordinary phases is carrying out phase A, reaching of the limit envisaged for accumulation of the mail B does not affect phase S, and likewise, in the case where the section performing the ordinary phases is carrying out phase B, reaching of the limit envisaged for accumulation of the mail A does not affect phase S.

The section set in phase S is moreover always declared ready (READY) for switching blocks 300 and 310. For this reason, switching of block 310 is carried out when the section performing the ordinary phase A towards B or B towards A has completed unloading of all the closed batches of mail A or mail B, respectively.

When it is detected that the quantity of mail R contained in the section carrying out the degraded phase S has dropped back below the reference value (or is about to drop below this value), and hence that tracks are again available for the other types of mail (or tracks for the other types of mail will be available soon), a semi-degraded operating phase H is carried out, according to which the mail R that is ready is unloaded with maximum priority, whilst mail A, B and H is still being accumulated together.

Following upon a phase transition of the section carrying out the ordinary phases whereby phase A or phase B is arrived at, there also takes place a phase of transition from phase H to the phase complementary to that of the other section. In this way, if one first section is carrying out phase H and the second section reaches phase A, the first section will be switched from phase H to phase B; likewise, if the first section is carrying out phase H and the second section reaches phase B, the first section will be switched from phase H to phase A.

Figure 4:
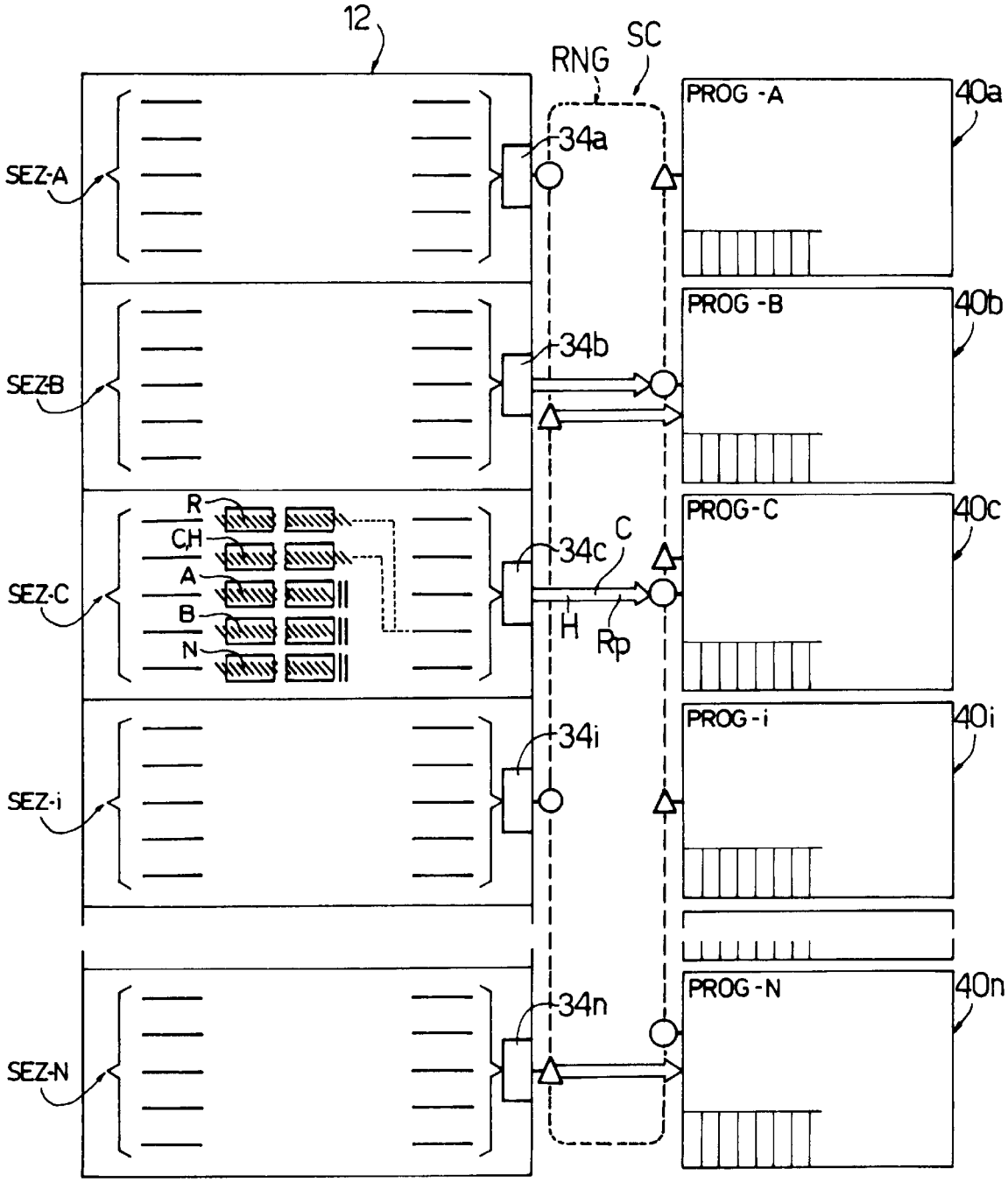
FIG. 4 is the diagram of a first variant of the method of the present invention.

More generally (FIG. 4), the accumulating device 12 may be provided with a number of sorting devices 40*a*, 40*b*, 40*c*, . . . , 40*n*, each of which operates according a specific sorting programme PROG-A, PROG-B, PROG-C, . . . , PROG-N to sort usefully a specific type of mail A, B, C, . . . , N.

The sorting programmes PROG-A, PROG-B, PROG-C, . . . , PROG-N may be all different from one another, or else two or more programmes may be the same as each other. In particular, sets of sorting devices may also be envisaged in which all the sorting devices belonging to the same set operate using the same sorting programme.

Furthermore, the accumulating device 12 may be divided into a number of sections SEZ-A, SEZ-B, SEZ-C, . . . , SEZ-i, . . . , SEZ-N, distinct from one another, each of which can communicate with one or more sorting devices 40*a*, 40*b*, 40*c*, . . . , 40*n* by means of an interconnection device SC (illustrated schematically) interposed between the outputs of the singling devices 34*a*, 34*b*, 34*c*, . . . 34*n* receiving the postal items coming as output from their respective sections SEZ-A, SEZ-B, SEZ-C, . . . , SEZ-N, and the inputs of the sorting devices 40*a*, 40*b*, 40*c*, . . . , 40*n*.

In particular, the interconnection device may be made with a ring track RNG along which are conveyed the sets of postal items and/or the singled postal items, said ring track RNG communicating, by means of corresponding input devices (represented by circles), with the outputs of the sections for receiving the postal items fed as output from the sections themselves, and being provided with switching devices (represented by triangles) for feeding towards corresponding sorting devices postal items that flow along the ring track RNG.

According to the above embodiment, each section SEZ-i can carry out an ordinary operating phase according to which it is designed to communicate with at least one of the sorting devices 40*a*, 40*b*, 40*c*, . . . , 40*n* performing its own sorting programme PROG-A, PROG-B, PROG-C, . . . , PROG-N for sorting usefully a specific type of mail A, B, C, . . . , N. Mail A is obviously the one that is sorted usefully by PROG-A alone, mail B is the one that is sorted usefully by PROG-B alone, mail C is the one that is sorted usefully by PROG-C alone, and so forth.

During this ordinary operating phase, the typical mail is accumulated and then unloaded towards the sorting device (or the sorting devices when the section operates with more than one sorting device)—typical mail being the postal items that can be usefully sorted by the programme associated to the at least one sorting device communicating and operating with said section—together with mail H and mail Rp (ready) if the latter do not have available special preferential programmes. During the ordinary operating phase, the atypical mail, i.e., the postal items that can be usefully sorted by programmes other than the one associated to the sorting device (or devices) with which the section is communicating, is accumulated in the section of the buffer 12. The accumulation of this atypical mail is carried out separately; that is, different types of atypical mail which can be usefully sorted by different sorting devices (and hence by different sorting programmes) are kept separate from each other.

For example, if a section, for instance SEZ-C, is communicating with the sorting device 40*c* carrying out the programme PROG-C, the typical mail C, mail H and mail Rp (ready) are fed as output from the section towards the sorting device, whilst the mail other than mail C, i.e., the mail A, B, . . . , N (with the exclusion of C) which is atypical for that section, is accumulated separately in the section. The R mail that is not ready is withheld inside the section of the accumulating device 12 awaiting coding of its destination. The mail H may be accumulated together with the mail C.

Exit of the section from the ordinary operating phase may take place on account of the storage limit being reached.

Reaching of the storage limit is defined by means of a multicriterion, i.e., the storage limit is said to be reached, in the first place, if the following condition has come about:

a) at least one type of atypical mail stored in the section has reached a storage level equal to a first threshold THRESHOLD1 of a settable type.

If condition a) is not met, in the second place the following is ascertained:

b) whether at least two types of atypical mail have both reached a storage level equal to a second threshold THRESHOLD2 of a settable type (with THRESHOLD2<THRESHOLD1).

If condition b) is not met either, the operations of comparison referred to above are repeated iteratively for successive increasing numbers of types of atypical mail with successive thresholds until it is generically checked whether at leas n different types of atypical mail accumulated in the section of the buffer 12 have all reached a threshold level THRESHOLDN of a settable type (with THRESHOLDN<THRESHOLD2<THRESHOLD1).

If at least one of the comparisons illustrated above is met, the storage limit is said to have been reached.

Once the condition of storage limit reached is met, it is checked which type of atypical mail, among the types of atypical mail that meet the multicriterion referred to above, has reached the maximum level of filling, i.e., comprises the maximum number of postal items.

For example, in the case where the above-mentioned condition b) is met, we have the situation that one first and one second type of atypical mail exceed THRESHOLD2; next, it is then ascertained which between said first type and said second type of atypical mail comprises the higher number of postal items, and hence has reached the maximum filling level.

Should the multicriterion stop at comparison a) (or should in any case no more comparisons be envisaged), the (single) type of atypical mail that reaches the storage limit necessarily comprises the maximum number of postal items.

Subsequently, a transition is carried out from the ordinary operating phase in use towards a different operating phase in which a type of atypical mail previously stored may be handled (i.e., fed towards a new sorting device).

In particular, should a set of realizability criteria be met, a phase of transition from the ordinary operating phase previously in use towards a different ordinary operating phase is carried out, in which the type of atypical mail that meets the storage limit condition and that has reached the maximum level of storage can be handled (i.e. fed towards a new sorting device).

In particular, the realizability criteria envisage as realizable those transitions from an ordinary operating phase in use to a different ordinary operating phase in which a type of atypical mail of the eligible type previously stored can be handled (i.e., fed towards a new sorting device).

An atypical type of mail is of the eligible type in the case where both these conditions are present:

an atypical mail is of an eligible type when the sorting device that carries out the sorting programme designed to sort that mail usefully is operating properly (i.e., a type of mail is eligible when there exists, for that type of mail, a sorting device, and this is properly operating);

an atypical mail is of an eligible type when the sorting device that carries out the sorting programme designed to sort that mail usefully has not received from another section a synchronism signal SYNC-OUT designed to start, for the section operating with the sorting device that receives the sync signal, a transition phase, at the end of which that sorting device that has been called will be used by the other, different, section.

Obviously, the conditions referred to above must be ascertained for one and the same device.

In this way, via the multicriteria referred to above, the type of atypical mail is selected that meets the storage-limit-reached condition, and the type of atypical mail that has reached the maximum level of filling is extracted. If the atypical mail that has reached the maximum level of filling is also eligible, a transition phase is carried out from the ordinary phase in use to an ordinary phase in which the eligible atypical mail can be sorted usefully. If, instead, the atypical mail that has reached the maximum filling level is not eligible (for example, because the sorting device that carries out the programme associated to it is out of order or because said sorting device has been "called" by a sync signal coming from a different section), the criterion is further used to retrace further types of atypical mail, among which the eligible type of atypical mail that has reached the maximum filling level is extracted. The search operations for a type of atypical mail that has reached the maximum filling level and that is also eligible are thus repeated until an eligible type of mail is extracted, and then it is identified towards which ordinary phase the transition phase must be directed.

During the transition phase, the typical mail is unloaded with maximum priority in that the section is still communicating with the sorting device with which it was operating during the ordinary operating phase. At the end of the transition phase, i.e., when all the closed batches of typical mail have been unloaded, the section activates a first ready signal READY-i.

In addition, upon starting-up of each transition phase, a sync request is sent by means of the sync signal SYNCR-OUT towards a sorting device that is called by the sync request. This sorting device that has been called is usefully sorting the same atypical mail which, in the section from which the sync signal comes, has reached the maximum level of filling and has been recognized as eligible.

The availability is thus guaranteed of a sorting device designed to handle the atypical mail previously accumulated; further call requests are ignored by the sorting device called.

The section co-operating with the sorting device that has been called sets itself in a transition phase towards an ordinary phase in which a type of atypical mail previously accumulated in the section can be handled as typical mail. To decide which type of atypical mail is to be selected (and hence which sorting device is to be called) the multicriteria previously described and the control on eligibility are used.

In this way, the section co-operating with the sorting device that has been called can in turn send a sync request towards the sorting device co-operating with the section by which it has been called and can set itself in a phase of transition towards an ordinary phase which is the same ordinary phase as that carried out by the section that has generated the call.

It is moreover clear how the section that has been called can send a sync request towards a sorting device other than the sorting device operating with the section that has been called and can set itself in a phase of transition towards an ordinary phase which is different from the ordinary phase carried out by the section that has generated the call.

During the transition phase, the typical mail of the section called is unloaded with maximum priority. When all the closed batches of typical mail have been unloaded, each section activates its own ready signal READY-y.

In the presence of all the ready signals READY-i . . . READY-y coming from the sections operating with sorting devices that have been called via SYNCR-OUT signals (these signals confirm completion of the syncrhonizations previously requested on two or more sections), via the interconnection device SC the switches for modifying the connections previously existing and for obtaining an interconnection between the sections that have generated the call and the sorting devices that have received the call are carried out.

Each section that has generated a SYNC-OUT signal is thus connected to the sorting device that has been called and has been defined READY.

In this way, each section that has generated a call is now operating with a sorting device that is carrying out a programme that enables unloading of the atypical mail previously accumulated, in particular a programme that performs sorting of the mail previously accumulated that has reached the accumulation limit and has been considered eligible.

It is clear how, should there be only two sorting programmes and two sections, the variant of embodiment previously described corresponds to the embodiment described with reference to FIGS. 3*a*–3*d*.

FIGS. 5*a*, 5*b*, 5*c* and 5*d* illustrate a simplified version of the post-office machine 1 operating according to a simplified version of the control method of the present invention.

According to this simplified embodiment, it is possible to use a single sorting device 40*a*, and a single section of tracks 20 can be defined, communicating, for example through the single singling device 34*a* and the track 50, with said single sorting device 40*a*. Consequently, the crosswise tracks 52, 56 or the track 54 are not envisaged. Likewise a single information-acquisition unit 3*a* receiving the flow F1 is envisaged.

Figure 5A:
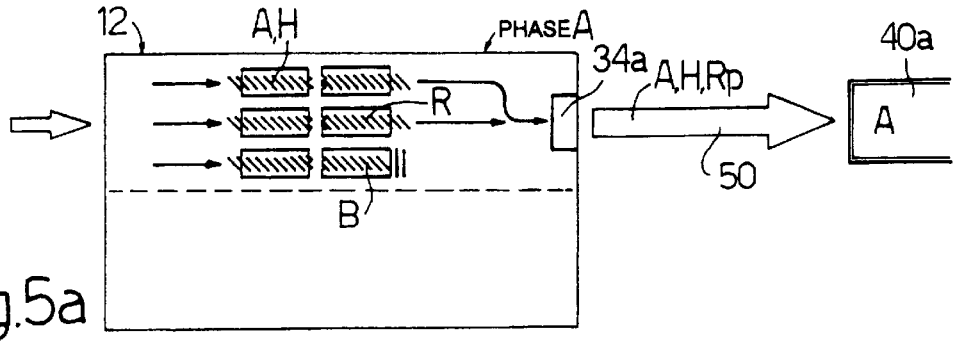
FIGS. 5*a*–5*d* present diagrams of phases of a second variant of the method of the present invention.

Initially, the section of the buffer is in phase A (FIG. 5*a*). During this phase, just as was said for block 100, the section is designed to communicate with the sorting device 40*a* which performs the programme A. Mail A, B, H and R is accumulated, and singled mail A, H and Rp (ready) is unloaded, whilst the mail B is accumulated. The mail R which is not ready is withheld inside the accumulating device 12 awaiting coding on its destination.

Figure 5B:
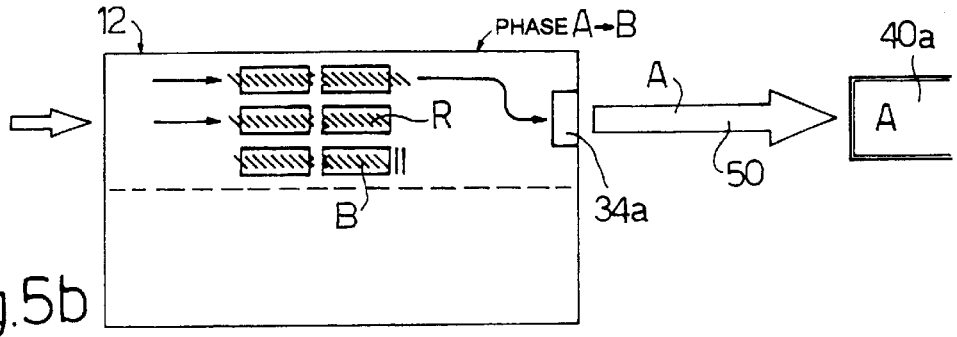
Figure 5C:
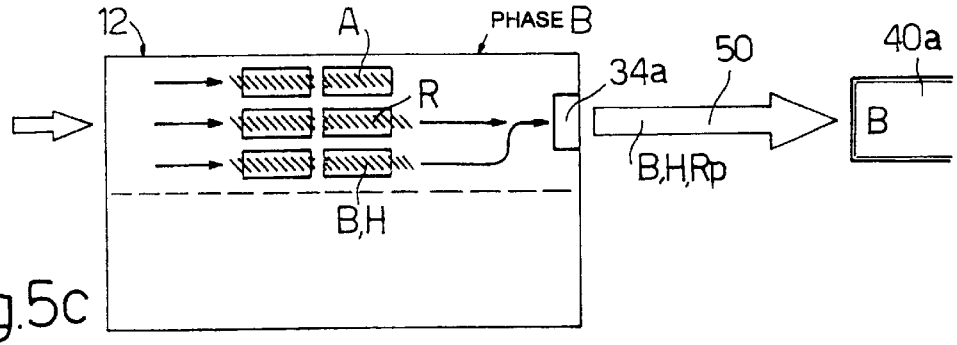

The section of the buffer remains in phase A (as was said for block 110) until the accumulation limit envisaged for mail B is reached. When this accumulation limit for mail B is reached, a command is issued for activation of the phase A→B (A towards B), in which the section communicating with the sorting device 40*a* still performing programme A is managed in such a way as to optimize a subsequent transition designed to enable activation of a different sorting programme for the sorting device 40*a*. The phase A towards B comprises the same operations as those previously described for this phase. In particular, the mail A is unloaded with maximum priority (FIG. 5*b*).

Once the operations of unloading of all the closed batches of mail A are completed, the phase A towards B terminates, and the section is declared ready to start a new phase.

The sorting programme A is thus replaced with a sorting programme B inside the sorting device 40*a*, and in the same section the B sorting phase is started which enables unloading of the postal items B previously accumulated and the accumulation of the postal items A.

Mail A, B, H and R is accumulated, and singled mail B, H and Rp (ready) is unloaded, whilst the mail A is accumulated. The mail R which is not ready is withheld inside the accumulating device 12 awaiting coding on its destination.

Figure 5D:
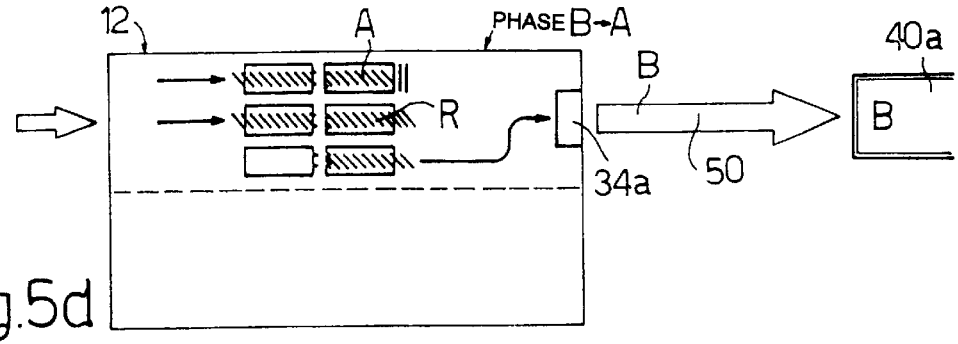

The section of the buffer remains in phase B (as was said for block 210) until the accumulation limit envisaged for mail A is reached. When this accumulation limit for mail A is reached, a command is issued for activation of the phase B→A (B towards A), in which the section communicating with the sorting device 40*a* still performing programme B is managed in such a way as to optimize a subsequent transition designed to enable activation of a different sorting programme for the sorting device 40*a*. The phase B towards A comprises the same operations as those previously described for this phase. In particular, the mail B is unloaded with maximum priority (FIG. 5*d*).

Once the operations of unloading of all the closed batches of mail B are completed, the phase B→A terminates, and the section is declared ready to start a new phase.

The sorting programme A is then re-loaded inside the sorting device 40*a*, and the operations previously described are repeated.

The example of embodiment illustrated regards a case in which only one sorting device is present operating according to two sorting programmes (programmes A and B) which are different from one another. According to this example of embodiment, it is not necessary to carry out any physical switching, but it is necessary to carry out a programme switching (i.e., load or activate programme A or B) to feed the sorting device with the mail previously accumulated in batches (for example, mail B batches and mail A batches) and corresponding to the specific sorting programme currently operating. In this connection, it may be noted how the batches of mail B accumulated in phase A are fed, following upon switching of the programmes, to the sorting device 40*a* which is operating according to programme B and is specifically designed to handle mail B (typical mail), and the batches of mail A accumulated in phase B are fed, following upon switching of the programmes, to the sorting device 40*a* which is operating according to programme A and is specifically designed to handle mail A (typical mail).

More generically, the sorting device 40*a* could operate according to a number of programmes PROG-A, PROG-B, . . . , PROG-X, PROG-Y . . . each of which is designed to sort usefully a specific type of mail.

Figure 6A:
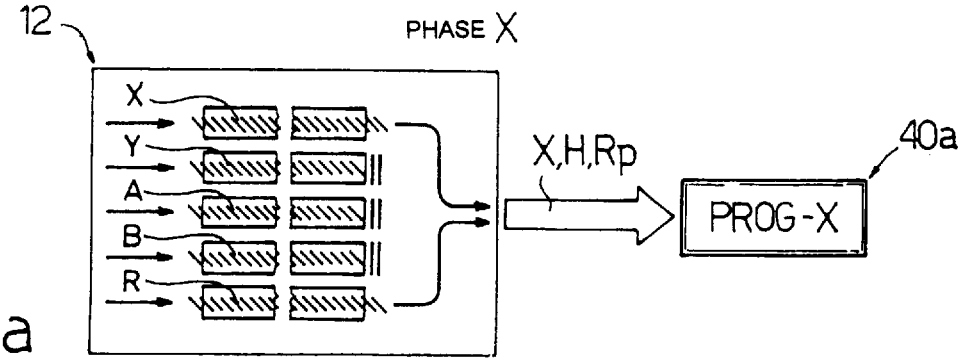
FIGS. 6*a*–6*f* present diagrams of phases of a third variant of the method of the present invention.

According to the above variant of embodiment, the section of the buffer may be in a generic phase X (FIG. 6*a*) in which the section is designed to communicate with the sorting device 40*a* which is performing a corresponding generic programme PROG-X. An ordinary operating phase is carried out in which the typical mail X that can be usefully sorted by the programme PROG-X currently in use is unloaded together with the mail H and the mail Rp (ready), whereas the mail that can be sorted usefully by other programmes different from the programme currently in use (atypical mail ( mail X) is accumulated in the buffer 12. Accumulation of this mail is carried out separately; i.e., the different types of mail that can be usefully sorted by the sorting device operating according to respective different sorting programmes. are kept separate from each other. In this way, mail A, mail B, mail Y, etc. is accumulated separately. The mail R which is not ready is withheld inside the accumulating device 12 awaiting coding on its destination.

The section of the buffer remains in phase X (as was said for block 110) until the accumulation limit envisaged for at least one of the types of mail that is only accumulated is reached. In the same way as was said previously, the multicriterion previously described can be applied to detect whether one or more types of atypical mail accumulated exceed an accumulation threshold previously defined, to issue a command for exiting the current phase and entering a different phase in which the section communicating with the sorting device 40*a* still performing the programme PROG-X previously in use is managed in such a way as to optimize a subsequent transition designed to enable activation of a different sorting programme for the sorting device 40*a*. Exit from the phase currently in use entails the carrying-out of a transition phase from the phase in use (phase X) to a different phase. The different phase can be selected from among all the possible phases (i.e., from among the phases different from the phase X in use) applying the multicriterion previously described and, detecting, that is, whether one or more types of mail exceed an accumulation threshold previously defined, in order to select the specific programme for the type of mail detected via the multicriterion, i.e., the programme designed to sort usefully the type of mail that satisfies the multicriterion.

In order to provide an example, an X-towards-Y transition phase is illustrated (FIG. 6*b*) in the case in which mail Y (i.e., the mail that can be sorted usefully by the sorting programme PROG-Y alone) has met the multicriterion referred to above.

Figure 6B:
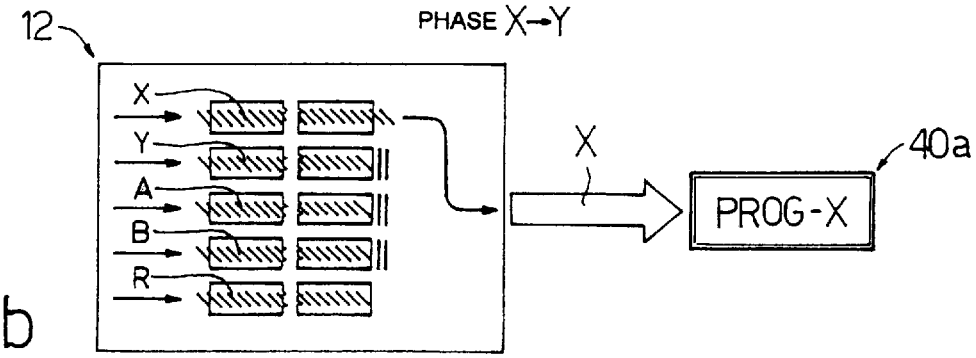

The carrying-out of the transition phase comprises the same operations as those described previously for this phase. In particular, the mail (mail X) already sent towards the sorting device in the previous phase is now unloaded with maximum priority (FIG. 6*b*).

At the end of the operations of unloading of all the closed batches of the mail already sent to the sorting device in the previous phase of ordinary operation (mail X), the phase of transition X→Y terminates, and the section is declared ready for starting the new ordinary phase Y.

Figure 6C:
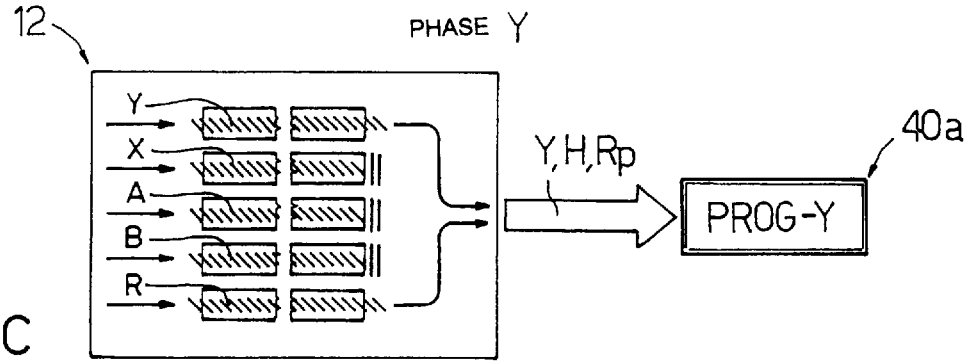

The sorting programme PROG-X is then replaced (switching operation) with a sorting programme PROG-Y inside the sorting device 40*a* (FIG. 6*c*), and in the section the Y sorting phase is started up which enables unloading of the postal items Y (typical mail) previously accumulated and accumulation of the postal items (atypical mail) different from the postal items Y. The mail different from Y (e.g., mail A, mail B, and mail X) is accumulated, whilst the singled mail Y, the mail H and the mail Rp (ready) is unloaded. The mail R which is not ready is withheld inside the accumulating device 12 awaiting coding on its destination.

The section of the buffer remains in the new Y phase (as was said for block 210) until the limit set (for example, via the multicriterion referred to previously) for accumulation of the atypical mail different from Y is reached. Upon reaching of the accumulation limit of the mail different from Y, a command is issued for activation of a new transition phase.

Exit from the phase Y currently in use entails the carrying-out of a transition phase from the phase in use (phase Y) to a different phase. As was said previously, the different phase can be selected from among all the possible phases (i.e., from among the phases different from the phase Y in use) on the basis of the multicriterion previously described to detect the type of mail that satisfies the relation with the threshold. The programme specific for that type of mail is thus selected, i.e., the programme designed to sort usefully the type of mail that satisfies the multicriterion.

Figure 6D:
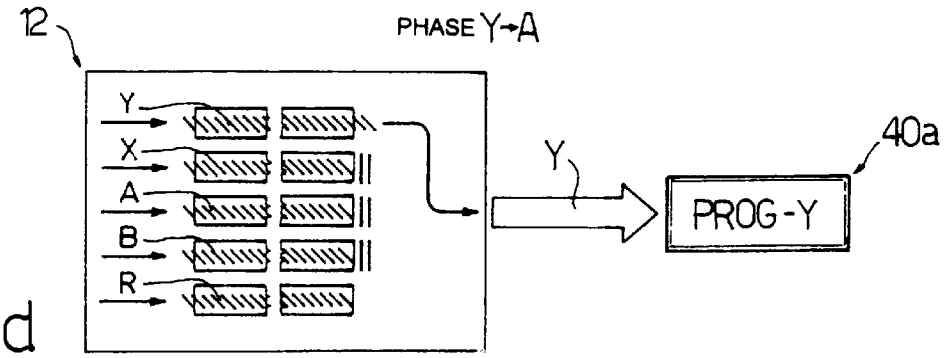
Figure 6E:
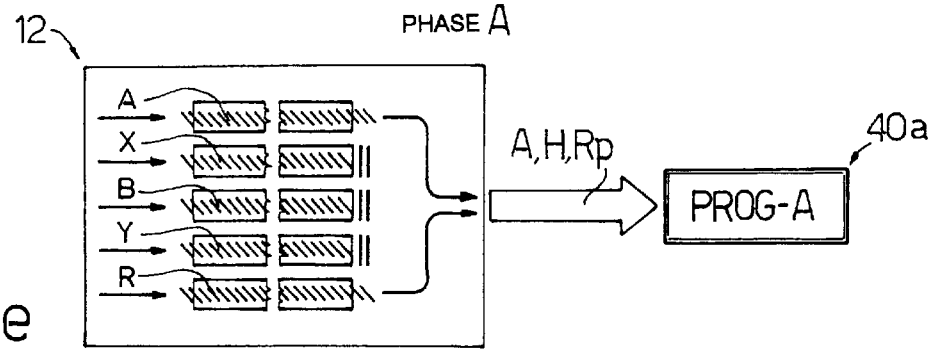
Figure 6F:
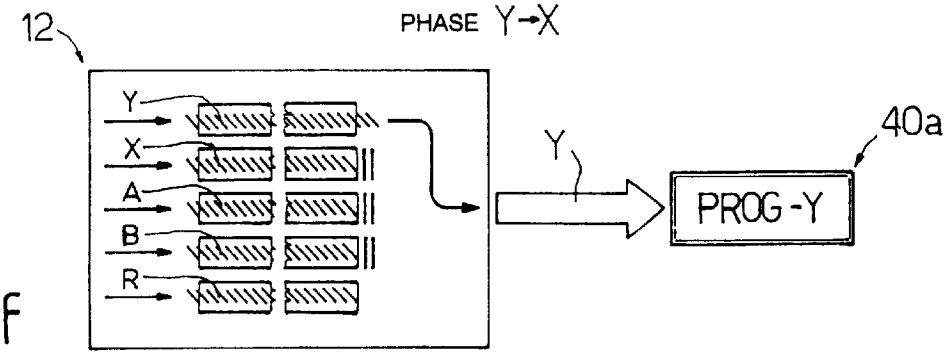

To provide an example, it is clear how a Y-towards-A transition phase (FIG. 6*d*) may be performed for unloading of the mail Y with maximum priority, and a subsequent phase A (FIG. 6*e*) may be performed in which the mail A is fed to the accumulating device performing the sorting programme PROG-A, or else, a Y-towards-X transition phase (FIG. 6*f*) may be performed again for unloading of the mail Y with maximum priority, and the ensuing ordinary phase X (FIG. 6*a*) may be subsequently repeated.

Finally, it is clear that modifications and variants can be made to the method described and illustrated herein without, however, departing from the scope of protection of the present invention.

What is claimed is:

1. A method for controlling an accumulating device designed to receive, as input, postal items and designed to feed as output postal items to at least one mail sorting device designed to address (T) each postal item fed as input towards a corresponding output according to data (CODE1, CODE2) associated to the item itself, the method comprising the steps of:

providing said accumulating device which includes a number of tracks, each of which extends between an input designed to receive postal items and an output; said tracks defining at least one accumulation segment, along which postal items can be accumulated defining at least one section comprising a set of tracks;

carrying out an ordinary operating phase for said at least one section, according to which the section is designed to communicate with at least one mail-sorting device performing a corresponding sorting program (PROG-A, PROG-B, PROG-C, . . . , PROG-N) in order to sort usefully a specific type of postal items (A, B, C, . . . N);

wherein said ordinary operating phase comprises the phases of accumulating in the at least one section and unloading towards the sorting device postal items that constitute a typical mail which can be usefully sorted by the program being used in the sorting device communicating and operating with the at least one section; said ordinary operating phase including the phase of accumulating in the at least one section postal items that constitute atypical mail which can be sorted usefully by at least one program different from the program currently being used in the sorting device with which the section is operating and communicating;

detecting a condition of end of ordinary operation; and carrying out a phase of transition from the phase of ordinary operation towards a different phase of operation in which at least one type of atypical mail previously stored in the at least one section may be handled;

detecting the end of the transition phase and performing a switching operation in such a way the, following upon switching, said at least one section may operate with a sorting device performing a different sorting program to carry out said different operating phase in which mail previously accumulated is fed towards the sorting device that can usefully sort said previously accumulated mail.

2. Method according to claim 1, wherein said transition phase comprises the phase of unloading with maximum priority the typical mail present in the section towards the sorting device designed to sort usefully said typical mail.

3. Method according to claim 1, wherein said accumulating device co-operates with a number of sorting devices, each of which carries out a sorting program (PROG-A, PROG-B, PROG-C, . . . , PROG-N) for sorting usefully one type of mail (A, B, C, . . . , N); a number of sections being defined, each of which is designed to communicate (SC) with at least one sorting device;

said ordinary operating phase for one of said sections comprising the phase of accumulating separately the atypical mail in such a way that different types of atypical mail that can be usefully sorted by different sorting devices are kept separate from each other inside said section.

4. Method according to claim 1, wherein said phase of detecting a condition of end of ordinary operation comprises the phase of detecting a reached storage limit of at least one type of atypical mail.

5. Method according to claim 4, wherein said phase of detecting a reached storage limit of at least one type of atypical mail comprises the phase of ascertaining, in the first place, whether at least one type of atypical mail stored in the section has reached a storage level equal to one first threshold (THRESHOLD1) of a settable type.

6. Method according to claim 5, wherein said phase of detecting a reached storage limit, should said ascertainment phase have yielded a negative result in the first place, further comprises the phases of repetition of the ascertainment operations for successive increasing numbers of types of atypical mail in order to detect whether at least n different types of atypical mail accumulated in the section have all reached a storage level corresponding to an nth threshold (THRESHOLD) of a settable type.

7. Method according to claim 5, further including the phase of detecting which type of atypical mail, among the typical mail that reaches said storage level equal to a settable-type threshold, has reached the maximum filling level; said transition phase comprises the phase of performing a transition phase from the ordinary phase in use to a further ordinary phase in which the type of typical mail that has reached said maximum filling level can be sorted usefully.

8. Method according to claim 7, further including the phase of ascertaining whether the type of atypical mail that has reached said maximum filling level is also of the eligible type; wherein a type of mail is eligible when there exists a sorting device operating properly that is designed to sort that type of mail usefully; and when the sorting device designed to sort that type of mail usefully has not received from another different section a sync signal (SYNC-OUT) designed to start, for that section operating with the sorting device that receives the sync signal, a transition phase, at the end of which that sorting device that has been called will be used by the other, different, section;

only the phases of transition from an ordinary phase in use to an ordinary phase in which a type of eligible typical mail satisfying said maximum filling level is usefully sorted, being performable.

9. Method according to claim 8, further including the phase of sending, at start-up of each transition phase, a sync request by means of a sync signal (SYNCR-OUT) towards a sorting device which is called by the sync request; said sorting device being designed to sort usefully that same atypical mail which, in the section from which the sync signal comes, has satisfied said storage limit.

10. Method according to claim 9, wherein said sorting device called is designed to sort usefully the type of atypical mail which, in the section from which the sync signal comes, has reached said maximum filling level and is of the eligible type.

11. Method according to claim 9, wherein at the end of a transition phase each section activates a ready signal (READY-y) of its own; in the presence of the ready signals (READY-i . . . READY-y) coming from the sections operating with the sorting devices that have been called by a sync signal, the switches are carried out via an interconnection device (SC) for modifying the connections previously existing and for making an interconnection between the sections that have generated the call and the sorting devices that have received the call.

12. Method according to claim 1, wherein said section co-operates with at least one sorting device operating alternately with various sorting programs (PROG-X, PROG-Y, PROG-A, PROG-B) to sort usefully respective different types of mail (X, Y, A, B); said phase of ordinary operation comprising the phase of setting in communication the section with the sorting device operating according to one first sorting program (PROG-X; PROG-A) to address towards a corresponding output at least first coded postal items that constitute one first typical type of mail (mail X; mail A) which can be sorted usefully by the first sorting program alone;

during said phase of ordinary operation any atypical type of mail that can be sorted usefully only by a respective sorting program different from the program currently in use is accumulated in the section; said phase of detecting a condition of end of ordinary operation comprising the phase of ascertaining a limit condition in said section and, upon reaching of said limit condition, activating said transition phase according to which the section communicating with the sorting device still carrying out the first program is managed in such a way as to optimize a subsequent transition designed to enable activation of a different sorting program;

following upon detection of the end of said transition phase, the operation being carried out of switching between the current program of said sorting device and another different program, and a further ordinary operating phase being activated according to which the section is designed to communicate with the sorting device operating according to the different sorting program to address towards a corresponding output at least second postal items previously stored which make up a second type of mail that can be usefully sorted by the different program different from the first program;

during said further phase of ordinary operation, the second type of mail is moreover fed to the sorting device, whilst any type of atypical mail that can be usefully sorted by a program different from the program currently in use is accumulated in the section;

said method further comprising the steps of ascertaining a limit condition and, upon reaching of said limit condition, activating a second transition phase according to which the section communicating with the sorting device still carrying out the program previously in use is managed in such a way as to optimize a subsequent transition designed to enable activation of a third sorting program.

13. Method according to claim 12, wherein said ordinary operating phase comprises one phase A of operation according to which the section is designed to communicate with the sorting device operating according to one first sorting program A to address towards a respective output at least first coded postal items that constitute one first type A of typical mail that can be usefully sorted by the program A alone; during said phase A, the first type of mail A is moreover fed to the sorting device, whilst one second type of mail B is accumulated in the section;

said transition phase comprising an A-towards-B transition phase according to which the section communicating with the sorting device still carrying out program A is managed in such a way as to optimize a subsequent transition designed to enable activation of a different sorting program;

said further ordinary operating phase comprising an operating phase B according to which the section is designed to communicate with the sorting device operating according to one second sorting program B to address towards a corresponding output at least second coded postal items that constitute said second typical type B of mail that can be usefully sorted by the program B alone;

during said phase B, the second type of mail B is moreover fed to the sorting device, whilst said first type of mail A is accumulated in the section;

said method further comprising a B-towards-A transition phase according to which the section communicating with the sorting device still carrying out program B s managed in such a way as to optimize a subsequent transition designed to enable activation of the sorting program A previously used; at the end of said B-towards-A transition phase, the operating phase A is repeated.

14. Method for controlling an accumulating device according to claim 1, wherein said accumulating device co-operates with two sorting devices, each of which carries out a corresponding sorting program A and B to sort usefully a corresponding type of mail A and mail B;

said method further includes the steps of defining and delimiting one first section (SEZs) and one second section (SEZi);

performing a phase A of ordinary operation according to which the first section is designed to communicate with the first sorting device; during said phase A at least the first type of mail A is moreover fed to the first sorting device, whilst at least the second type of mail B is accumulated in the first section;

performing a phase B of ordinary operation according to which the second section is designed to communicate with the second sorting device; during said phase B, at least the second type of mail B is moreover fed to the second sorting device, whilst at least the first type of mail A is accumulated in the second section;

ascertaining a limit condition and, upon reaching of said condition, activating:

one first A-towards-B transition phase according to which the first section still communicating with the first sorting device is managed in such a way as to optimize a subsequent transition designed to enable feeding of the second sorting device operating according to the sorting program B;

one second B-towards-A transition phase according to which the second section still communicating with the second sorting device is managed in such a way as to optimize a subsequent transition designed to enable feeding of the first sorting device operating according to the sorting program A;

ascertaining a sync condition and, upon reaching of said sync condition, carrying out said switching operation by switching the outputs and thus rendering the first section communicating with said second sorting device and rendering the second section communicating with said first sorting device to carry out phase B in said first section and phase A in said second section.

15. Method according to claim 14, wherein said phase of ascertaining a limit condition comprises the phases of ascertaining the presence of said limit condition in said first section and in said second section, and of activating at the same time the transition from said phase A to said A-towards-B transition phase and from said phase B to said B-towards-A transition phase upon detection of said limit condition in one of said first section and second section.

16. Method according to claim 14, further including the phase of accumulating postal items along accumulation segments creating closed batches of postal items defining a pre-set occupation of the segment, said phase of ascertaining a sync condition comprising the phases of:

ascertaining the unloading of all the batches closed and available for output of mail A from one first section;

ascertaining the unloading of all the batches closed and available for output of mail B from one second section;

carrying out said switching operation of the outputs in the case where said ascertainment phases have both yielded a positive result.

17. Method according to claim 1, including defining mail H which comprises residual postal items that are in any case sorted usefully by a sorting program;

said phase of ordinary operation comprising the phase of accumulating, on at least one track belonging to the section that is in the ordinary operating phase, typical mail together with mail H.

18. Method according to claim 1, including defining mail H which comprises residual postal items that are in any case sorted usefully by a sorting program;

during a phase of ordinary operation of a section, typical mail and mail H being fed to the sorting device co-operating with said section.

19. Method according to claim 1, including defining mail R comprising postal items introduced inside the accumulating device without the data characterizing their postal destination;

during a phase of ordinary operation, sets of postal items comprising mail R being accumulated on at least one track belonging to the section that is in the ordinary operating phase.

20. Method according to claim 19, wherein the mail R is accumulated separately from the other types of mail inside a section.

21. Method according to claim 1, including defining mail comprising postal items introduced inside the accumulating device without data characterizing their postal destination; in said ordinary operating phase, typical mail and decoded R mail (Rp) being fed to the sorting device operating with the section, said decoded mail being associated to data characteristic of postal destination processed during the period of stay of the mail R inside the accumulating device.

22. Method according to claim 1, including defining mail H comprising residual postal items that are in any case sorted by a sorting program; said transition phase comprising the phase of separating, in the course of accumulation and inside said section, the mail H from the typical mail.

23. Method according to claim 1, including the phase of singling the postal items traveling as output from a section to feed, as input to at least one sorting device, flows of singled postal items.

24. Method according to claim 14, further including the steps of:

monitoring in said sections critical conditions of operation;

activating a phase S of degraded operation for the section in which said critical conditions of operation have been detected;

carrying out ordinary operation in the other section, performing one of said phases A, B, A towards B, and B towards A.

25. Method according to claim 24, including defining mail R comprising postal items introduced inside the accumulating device without data characterizing their postal destination; the phase being moreover performed of attempting to associate, to each postal item belonging to the mail R and during the stay of the mail R inside the accumulating device, data characterizing its postal destination;

said phase of detecting in said sections critical conditions of operation comprises the phases of:

monitoring in said sections the quantity of mail R that is not ready and is still without data characterizing its postal destination;

detecting the critical conditions in one section when the quantity of mail R that is not ready exceeds a pre-set reference limit in said section.

26. Method according to claim 25, including the steps of:

monitoring a condition of end of critical state for the section performing said degraded phase S;

activating a phase H of semi-degraded operation upon detection of said condition of end of critical state; said phase H of semi-degraded operation comprising the phases of unloading with maximum priority the mail R for which the data on postal destination are ready (Rp) and accumulating mail A and mail B jointly.

27. Method according to claim 26, including the steps of:

detecting a phase transition in the section carrying out the ordinary phases; said phase transition bringing the section to phase A or phase B; and performing, in the other section carrying out the semi-degraded phase H, a phase transition to bring said section from phase H to a phase complementary to the one that the other section reaches following upon the phase transition; phase A being complementary to phase B and vice versa.

28. Method according to claim 24, wherein said degraded operating mode S comprises the phases of accumulating mail B together with mail A.

29. Method according to claim 1, wherein each sorting program (A, B) converts a code associated to the postal item into an output number to send the postal item to a physical output of the sorting device.

30. Method according to claim 1, wherein said phase of accumulating said postal items in said accumulating device comprises the phase of accumulating partially overlying (shingled) postal items aligned along one direction and presenting corresponding edges spaced apart by a controlled pitch.

31. Method according to claim 1, wherein said switching operation is carried out by feeding postal items along a ring track (RNG), along which the postal items are conveyed; said ring track (RNG) communicating, by means of at least two input devices, with corresponding outputs of sections to receive the postal items fed as output from the sections, and being provided with at least two switching devices to feed, towards corresponding sorting devices, postal items that flow along the ring track (RNG).

* * * * *